United States Patent [19]

Balbuena

[11] 4,372,077

[45] Feb. 8, 1983

[54] COMBINED BOOK, FLANNELBOARD AND HAND PUPPET

[76] Inventor: Dora O. Balbuena, 799 Larkspur Dr., Sandy, Utah 84070

[21] Appl. No.: 279,303

[22] Filed: Jul. 1, 1981

[51] Int. Cl.[3] ..... A63H 3/14; G09B 1/02

[52] U.S. Cl. ..... 46/116; 46/154; 434/178; 434/429

[58] Field of Search ..... 46/13, 34, 116, DIG. 1; 434/156, 172, 178, 429

[56] References Cited

U.S. PATENT DOCUMENTS

| | | | |
|---|---|---|---|
| 1,043,596 | 11/1912 | Hull | 434/429 |
| 1,490,295 | 4/1924 | Stephens | 434/178 |
| 2,946,137 | 7/1960 | Worth et al. | 434/178 |
| 3,316,669 | 5/1967 | Nachbar | 46/DIG. 1 |
| 3,737,196 | 6/1973 | Boder | 46/154 X |
| 3,783,553 | 1/1974 | Goozner | 46/116 |
| 3,918,180 | 11/1975 | Chamberlin | 434/178 |
| 4,063,369 | 12/1977 | Hart | 434/156 |

FOREIGN PATENT DOCUMENTS

| | | | |
|---|---|---|---|
| 813456 | 5/1959 | United Kingdom | 46/154 |

*Primary Examiner*—F. Barry Shay

*Attorney, Agent, or Firm*—Mallinckrodt & Mallinckrodt

[57] ABSTRACT

An amusement device comprises in combination as a merchandisable packet a storybook, a flannel board, flannel board figures, and a hand puppet. The flannel board figures represent characters, objects, or scenes from the storybook story and the puppet is a likeness of one of the story characters. The hand puppet is adapted to be manipulated by a hand in the normal manner and the puppet includes a storage pocket therein to receive and store the storybook, flannel board and flannel board figures.

9 Claims, 4 Drawing Figures

COMBINED BOOK, FLANNELBOARD AND HAND PUPPET

BACKGROUND OF THE INVENTION

1. Field

The invention is in the field of amusement devices and particularly in the field of amusement devices for children which are used in connection with book reading and storytelling.

2. State of the Art

Storytelling has always been popular with people of all ages. With the development of written language and the printing press, many stories have been recorded in books. A large number of enjoyable stories are now available in storybooks of all shapes, sizes, and languages. When reading storybooks to children it is important to involve the listener's sense of sight as well as his sense of hearing. Thus, it has been common to employ drawings or pictures of characters and scenes as illustrations in books. It has also been popular to make puppets and dolls of well known characters so that children can act out their own stories using such puppets or dolls. Flannel boards have been used with two dimensional cutouts of well known characters so that children can act out their own stories using such character or such characters may be used as aids in telling stories to children.

BRIEF SUMMARY OF THE INVENTION

The present invention is intended to aid a child in becoming more involved in a storybook story as it is read to him. It combines the simplicity of using a flannel board with the flexibility and enjoyment of using puppets. Furthermore, convenient storage of all components is provided for.

The invention includes as part of a merchandisable packet a storybook telling a story; a flannel board; flannel board figures corresponding to characters and/or scenes from the story; and a hand puppet, the puppet being a likeness of one of the main characters from the story. The puppet is also adapted to receive the storybook, flannel board, and figures for storage in a storage pocket provided therein.

THE DRAWING

In the accompanying drawing, which represents the best mode presently contemplated for carrying out the invention:

FIG. 1 is a front view of a hand puppet of the invention showing a flannel board in folded configuration ready for insertion into the storage pocket of the puppet and a story book partially inserted into the storage pocket;

FIG. 2, a view of the flannel board set up for use and showing two figures attached thereto;

FIG. 3, a longitudinal vertical section taken along the line 3—3 of FIG. 1; and FIG. 4, a fragmentary vertical section taken along the line 4—4 of FIG. 2 and drawn to a larger scale.

DETAILED DESCRIPTION OF THE ILLUSTRATED EMBODIMENT

The device of the invention includes a storybook 9 shown partially inserted into the storage pocket in the puppet and having a story printed therein, a flannel board 10, figures 11 relating to the story and adapted to be held by the flannel board, and a hand puppet 12 which is a likeness of one of the characters in the story.

Figure 1:
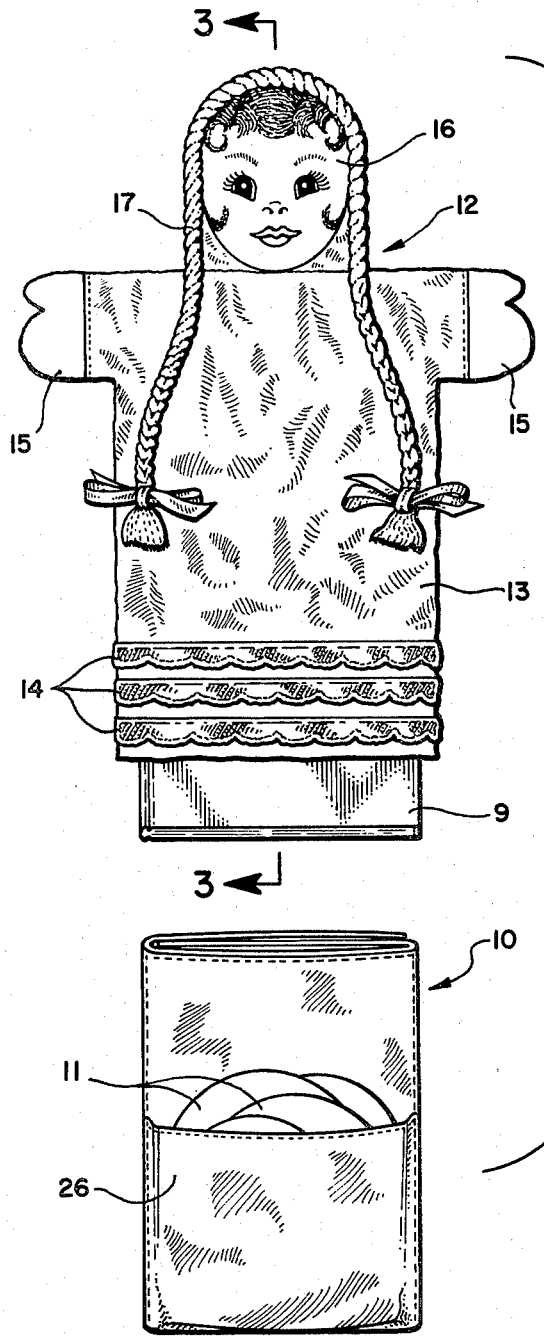
Figure 3:
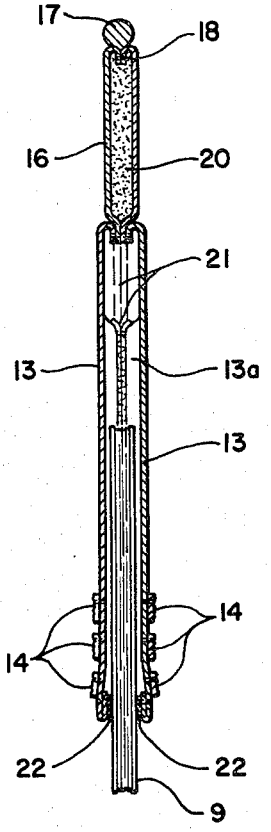

The puppet 12 may be made in any standard fashion from various materials so as to have the desired appearance. The puppet shown in FIGS. 1 and 3 represents a young lady, the body of which is formed of a fabric 13 to which lace 14 is applied for decoration. A different fabric, preferably of a desired skin coloration, is used for construction of the hands 15 and face 16. Appropriate markings such as those shown on the face in FIG. 1 may be applied by some well known method such as silk screening. The long braided hair shown in FIG. 1 may conveniently be a length of appropriately colored braided yarn 17 secured to portions of the head as at 18. A third fabric material corresponding to the appropriate hair color is secured to the face 16 and forms the back of the head 19. The head may be filled with a stuffing material 20 to give it shape and body. The various portions of the puppet 12 may be secured to one another by stitching, as at 21. Of course, various other materials and construction for the puppet may be used. For example, the head may be molded of a plastic material with three dimensional facial features included.

The body of the puppet below the head is made so that a hand may be inserted through the body and the puppet may be supported and moved in normal manner. For this purpose, the fabric 13 is secured together to form a pocket 13*a*, FIG. 3. The arms may be fabricated so that each receives a finger, thereby allowing each arm to be moved independently. The head may have a space for a finger to be inserted to move the head in various directions or to provide the movement of facial features such as opening and closing of the mouth, particularly if the puppet represents an animal or fanciful character. In some instances the puppet may be constructed so that the hand is inserted merely as a support for the head the puppet is moved as a whole.

The body of the puppet is also constructed so that the book 9, flannel board 10, and figures 11 fit within puppet 12 in the area below the head. As shown, the storage pocket may be the same space 13*a* in the puppet into which the hand is inserted when the puppet is used, or it may be a separate pocket provided in the body either in front of or behind the space for the hand. Thus, the space for the hand may be made a convenient size for fingers to reach into both arms and into the head while a larger storage pocket is provided behind the hand pocket for storage of the flannel board and book.

The storage pocket is preferably provided with closures 22 of the cocklebur type, such as of the proprietary material Velcro. This insures that the storybook, flannel board, and flannel board figures are retained in place inside the body of the puppet when they are placed therein for storage. Of course, the closures could also be buttons, snaps, a zipper, or the like.

Figure 2:
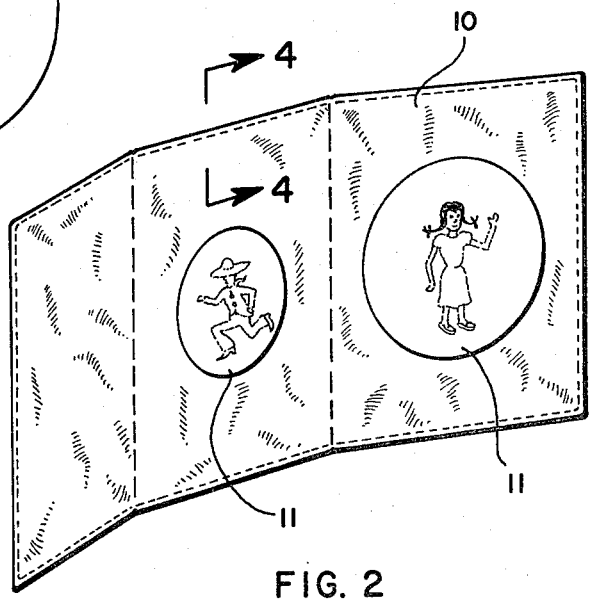
Figure 4:
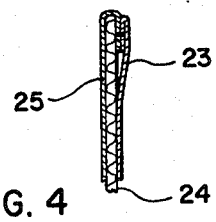

The flannel board 10 is preferably adapted to be folded as shown in FIGS. 1 and 2 so that a relatively large flannel board may be easily stored. The flannel board is conveniently constructed by securing pieces of flannel or other suitable fabric 23 around a stiffener material 24, such as cardboard. The back and sides of the board may be covered with a decorative material 25 such as a colored vinyl or cloth. A pocket 26 may be conveniently provided on the outside of the flannel board in which the various flannel board figures 11 may be stored. The flannel board can be set up by partially unfolding it as in FIG. 2 and standing it on one side. It should be noted that flannel boards are sometimes referred to as felt boards.

The flannel board figures 11 may be printed on any suitable fabric material that will stick on the flannel board, such as a nonwoven interfacing material similar to the proprietary fabric Pellon. These figures may be conveniently printed on the chosen material by a well known method such as silk screening and may take the form of individual characters or other items such as buildings or trees or may take the form of larger scenes. The figures may be pre-cut and colored or may be printed on a single sheet of material with only the outlines of such figures so that the user may color the figures and cut them out. The figures used in connection with a given book should include characters and scenes from the book, keeping in mind the idea that a listener should be able to act out the story with the various figures and the puppet.

When the story and other play with the device is completed, the flannel board figures may be placed into pocket 26 of flannel board 10. The folded flannel board and storybook may then be slipped into the storage pocket of the body of the puppet for storge, and retained therein by closures 22.

The book that comes in the pocket may be a fully illustrated and bound edition of the story or may be in booklet form with a minimum of illustrations since the flannel board figures and puppet can take the place of most of the illustrations.

The combination of the story book, flannel board, flannel board figures, and puppet provide a unique package of related materials which can be used by a child alone, or by a grown up playing with a child, to get much more play and enjoyment than could be obtained by the book alone. Further, the combination provides a unique merchandising package for the materials, and a convenient storage place for the materials so that they are neatly stored and easy for a child to put away.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An amusement device comprising in combination as part of a merchandisable packet, a storybook; a flannel board; flannel board figures, said figures including characters or scenes taken from the storybook story and printed on a material adapted to hold in place when placed on the flannel board; and a hand puppet adapted to be manipulated by a hand and having a storage pocket therein to receive said storybook, flannel board, and figures for storage, said puppet being a likeness of one of the characters in the story.

2. An amusement device according to claim 1, wherein the puppet is adapted to be manipulated through the insertion of a hand in a hand insertion pocket in the puppet.

3. An amusement device according to claim 2 wherein the hand insertion pocket is also the storage pocket.

4. An amusement device according to claim 3, wherein the puppet is provided with closure means for the storage pocket so as to retain the storybook, flannel board, and flannel board figures therein for storage.

5. An amusement device according to claim 1, wherein the flannel board is adapted to be folded for storage.

6. An amusement device according to claim 1, wherein the flannel board figures are printed on a single piece of suitable material and are cut out for use.

7. An amusement device according to claim 6, wherein the flannel board figures are uncolored and are to be colored prior to use.

8. An amusement device according to claim 7, wherein the material is a non-woven, interfacing type of material.

9. An amusement device according to claim 1, wherein the puppet is provided with closure means for the storage pocket so as to retain the storybook, flannel board, and flannel board figures therein for storage.

* * * * *